US007952286B2

(12) United States Patent
Fuchs et al.

(10) Patent No.: US 7,952,286 B2
(45) Date of Patent: May 31, 2011

(54) MERCURY SOURCE

(75) Inventors: Kirsten Fuchs, Kissing (DE); Gerald Hämmer, Königsbrunn (DE); Thomas Noll, Kipfenberg (DE); Klaus Pankratz, Freihalden (DE)

(73) Assignee: OSRAM Gesellschaft mit beschränkter Haftung, München (DE)

( * ) Notice: Subject to any disclaimer, the term of this patent is extended or adjusted under 35 U.S.C. 154(b) by 0 days.

(21) Appl. No.: 12/311,670

(22) PCT Filed: Oct. 19, 2007

(86) PCT No.: PCT/EP2007/061237

§ 371 (c)(1),
(2), (4) Date: Apr. 8, 2009

(87) PCT Pub. No.: WO2008/052895

PCT Pub. Date: May 8, 2008

(65) Prior Publication Data

US 2009/0278456 A1 Nov. 12, 2009

(30) Foreign Application Priority Data

Nov. 3, 2006 (DE) ..... 10 2006 052 025

(51) Int. Cl.
*H01J 17/20* (2006.01)

(52) U.S. Cl. ..... 313/639; 313/546

(58) Field of Classification Search ..... 313/639, 313/546

See application file for complete search history.

(56) References Cited

U.S. PATENT DOCUMENTS

| | | | |
|---|---|---|---|
| 5,500,567 | A | 3/1996 | Wilson et al. |
| 5,598,069 | A | 1/1997 | van Os et al. |
| 5,686,788 | A | 11/1997 | Lauter |
| 5,847,508 | A | 12/1998 | Borowiec et al. |
| 6,304,030 | B1 | 10/2001 | Driessens et al. |
| 2002/0158566 | A1 | 10/2002 | Van den Bogert et al. |

FOREIGN PATENT DOCUMENTS

| | | | |
|---|---|---|---|
| DE | 195 34 686 | A1 | 4/1996 |
| EP | 0 063 393 | A1 | 10/1982 |
| EP | 0 063 393 | B1 | 10/1982 |
| EP | 0 667 636 | A2 | 8/1995 |
| EP | 0 667 636 | B1 | 8/1995 |
| EP | 0 718 869 | A1 | 6/1996 |
| EP | 0 718 869 | B1 | 6/1996 |
| JP | 61 071540 | A | 12/1986 |
| WO | WO 99/62102 | A1 | 12/1999 |
| WO | WO 02/080224 | A2 | 10/2002 |
| WO | WO 02/080224 | A3 | 10/2002 |

*Primary Examiner* — Vip Patel

(74) *Attorney, Agent, or Firm* — Holtz, Holtz, Goodman & Chick, P.C.

(57) ABSTRACT

The invention relates to a mercury source for a low-pressure discharge lamp comprising an amalgam body which is arranged on a front surface of a wire or enclosed in a perforated structure. The amalgam body or the perforated structure is provided with a protective coating with a getter effect. The invention enables a simple production process to be implemented with low costs in terms of materials.

20 Claims, 4 Drawing Sheets

MERCURY SOURCE

This application is a U.S. National Phase Application under 35 USC 371 of International Application PCT/EP2007/061237, filed Oct. 19, 2007, which is incorporated herein in its entirety by this reference.

TECHNICAL FIELD

The invention relates to a mercury source for a low-pressure discharge lamp as claimed in the preamble of claim 1, a low-pressure discharge lamp with such a mercury source and a process for the production of a mercury source.

PRIOR ART

The prior art has disclosed amalgams for low-pressure discharge lamps in spherical form, which are positioned in an exhaust tube. The opening of the exhaust tube to the discharge vessel should firstly be relatively small in order to avoid the emergence of amalgam into the discharge vessel, since the functionality of the amalgam would be severely impaired because the temperature of the amalgam in the discharge vessel would be much too low, as is known from experience. Secondly, in the case of an opening at the exhaust tube which is too small, safe pumping and filling of the low-pressure discharge lamp is not ensured. In the prior art, for example, a retaining body in the form of an iron disk or an iron sphere is provided at the output of the exhaust tube and prevents the amalgam from passing through the opening. The manufacturing complexity involved for such a low-pressure discharge lamp is increased since the retaining body needs to be introduced into the exhaust tube. In addition, stringent requirements placed on the roundness of the amalgam spheres need to be complied with, which results in high costs owing to the sorting of the amalgam spheres.

Figure 1:
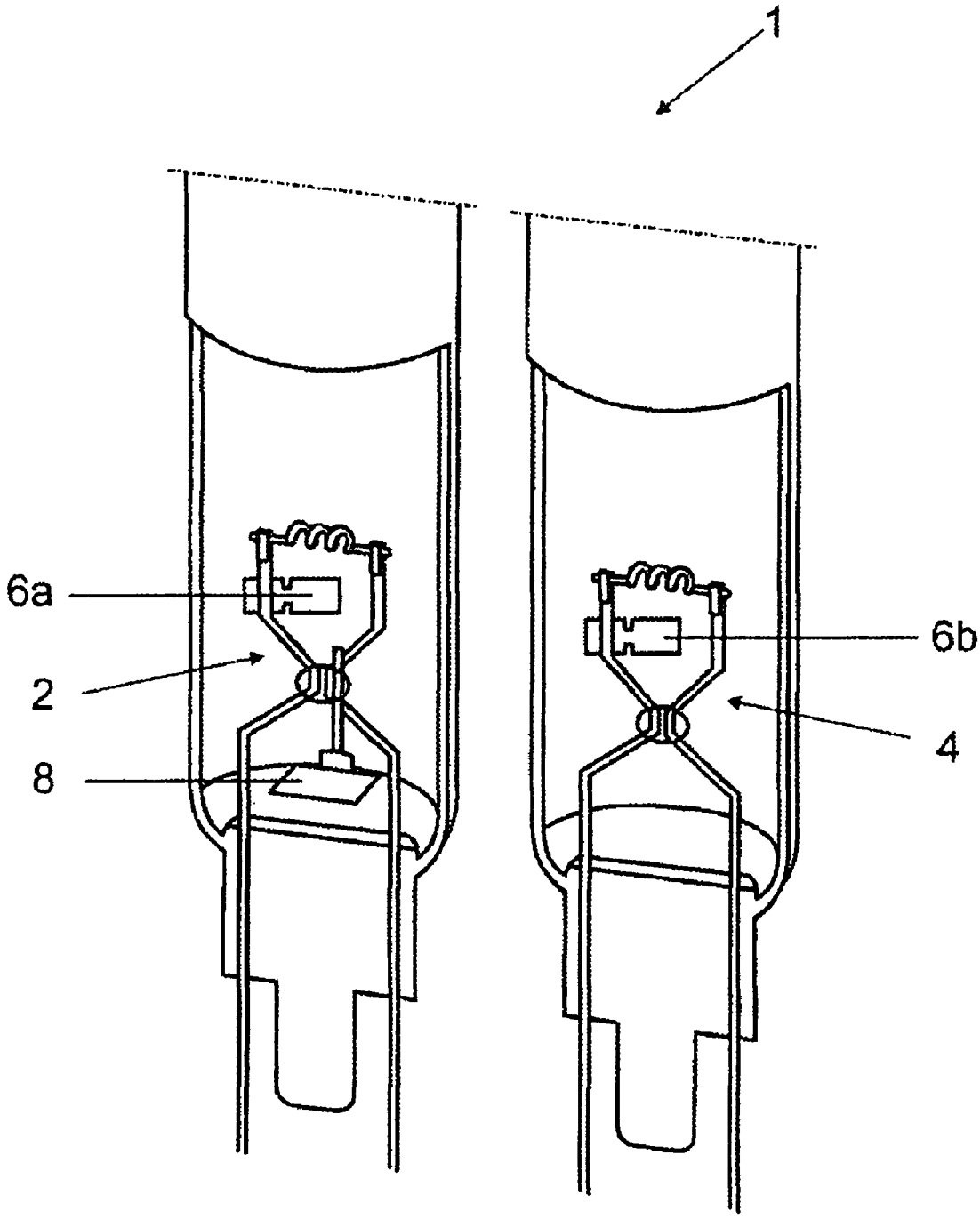

As an alternative to the amalgam in spherical form in the exhaust tube, high-temperature amalgam is applied to a metal substrate, as is shown in FIG. 1. FIG. 1 shows the discharge vessel 1, with electrodes 2, 4 being located at both end sections thereof. At these electrodes there are a respective startup flag 6*a*, 6*b* and, adjacent to the filament of the electrode, a working amalgam 8 on a wire, which is fastened on the glass bead of the electrode. It is necessary for the startup flag and the working amalgam to be fastened on the electrode separately. In contrast to the amalgam in the exhaust tube, however, the distance between the working amalgam 8 and the filament and therefore the working temperature and vapor pressure thereof can be set within a broader range.

In a known manner, the vapor pressure curve of the amalgam can be set in a specific range via the chemical composition thereof. In the case of the special high-temperature amalgam, particularly advantageous conditions result if the mercury component is approximately 10% by weight. This means that given a mercury quantity of 2.5 mg in a lamp, 25 mg of amalgam alloy needs to be applied to the amalgam substrate. Since the amalgam alloy is generally liquid during the production process of the lamp, said alloy must adhere particularly well to the amalgam substrate in order not to drip down in the case of vibrations. As regards the requirements for the metal substrate and the application process for the amalgam alloy, particular requirements therefore result which increase production costs.

DESCRIPTION OF THE INVENTION

The invention is based on the object of providing a mercury source whose manufacturing complexity and whose material costs are low and of providing a low-pressure discharge lamp with such a mercury source and a process for the production of such a mercury source.

This object is achieved according to the invention by the features of patent claim 1, and patent claims 11, 14 and 18.

In the case of a mercury source according to the invention for a low-pressure discharge lamp, an amalgam body is provided which is located on an end face of a wire or which is enclosed in a perforated structure. In this way, amalgam bodies with relatively pronounced deviations in terms of the geometrical design can be used in low-pressure discharge lamps. The production process is simple and the manufacturing costs are low.

It is preferred if the amalgam body or the perforated structure has a protective coating, as a result of which it is possible to prevent liquid or semi-liquid amalgam from emerging from the amalgam body.

In a further embodiment of the invention, the protective coating in the working temperature range of the low-pressure discharge lamp has a getter effect, in particular for hydrogen. As a result, hydrogen which has formed in the plasma during operation of the low-pressure discharge lamp can be bound from the plasma by the mercury source.

The protective coating is preferably a metal which does not form an amalgam with mercury, for example titanium. This results in good diffusion through the protective coating.

It is preferred if the amalgam body is substantially spherical, since spherical amalgam alloys can be produced very easily as long as there are no excessively stringent requirements placed on the roundness.

In accordance with one embodiment, the amalgam body is skewered onto a wire, with the result that the manufacturing complexity involved in the production of the mercury source is low.

Corresponding to a further embodiment, the amalgam body is enclosed in the perforated structure, which is preferably made from expandable metal. Such a configuration makes it possible to realize accommodation of the amalgam body in a cost-effective manner. Corresponding to a further configuration of the invention, a startup amalgam body is provided such that it is applied to expandable metal or enclosed in expandable metal on the wire opposite the working amalgam. This makes it possible to convert both startup amalgam and working amalgam in the low-pressure discharge lamp in a cost-effective manner.

The expandable metal can be connected to a glass bead, which is provided adjacent to the electrode, via a fastening device. As a result, the complexity involved with the apparatus for fastening the amalgam in the low-pressure discharge lamp can be reduced.

The fastening device is preferably in the form of a comb. The distance between the working amalgam and the filament can therefore be set in graduated fashion in a predefined manner.

It is preferable for a fastening device for the mercury source to be provided adjacent to the electrode in the case of a low-pressure discharge lamp according to the invention with a mercury source, as has been described above. A desired temperature at the amalgam body can thus be set.

The low-pressure discharge lamp preferably has a glass bead, at which the fastening device of the mercury source can be fastened. As a result, further fastening devices for the amalgam body in the low-pressure discharge lamp are not required.

The mercury source is fastened adjacent the electrode in such a way that a startup amalgam body is located closer to the electrode than a working amalgam body. As a result, the different temperature response of the startup amalgam and the working amalgam is taken into consideration.

Corresponding to a process according to the invention for the production of a mercury source, a wire and an amalgam body are provided, an end section of the wire is introduced into the amalgam body, preferably in the heated state, and then a protective coating is applied over the amalgam body. It is thus possible to implement a simple production process.

It is preferred for the protective coating to be applied by means of dip-coating, as a result of which the production complexity is even lower.

In a step which is performed after the application of the protective coating, the protective coating is dried in order to convert the protective coating in a simple manner.

Depending on the desired layer thickness of the coating layer, a multiple dipping and drying process may be advantageous.

It is preferred if the protective coating comprises titanium in order that a getter effect is provided for hydrogen, for example.

Corresponding to a further process of the present invention for the production of a mercury source, a perforated structure and an amalgam body are provided, the amalgam body is inserted into the open perforated structure, the perforated structure is closed and then a protective coating is applied to the perforated structure. It is thus possible to use an amalgam body which has different geometrical requirements placed on the spherical shape from those in the prior art. At the same time, the same luminous flux response is achieved as with mercury sources in accordance with the prior art.

The perforated structure preferably comprises expandable metal in order that the material costs can be kept low.

Owing to the protective coating or the coating layer, dripping of the amalgam during the manufacturing process of the lamp is additionally prevented. Furthermore, the limitation of quantities as mentioned at the outset is eliminated.

Particularly advantageous embodiments of the invention are described in the dependent claims.

BRIEF DESCRIPTION OF THE DRAWING(S)

Figure 2:
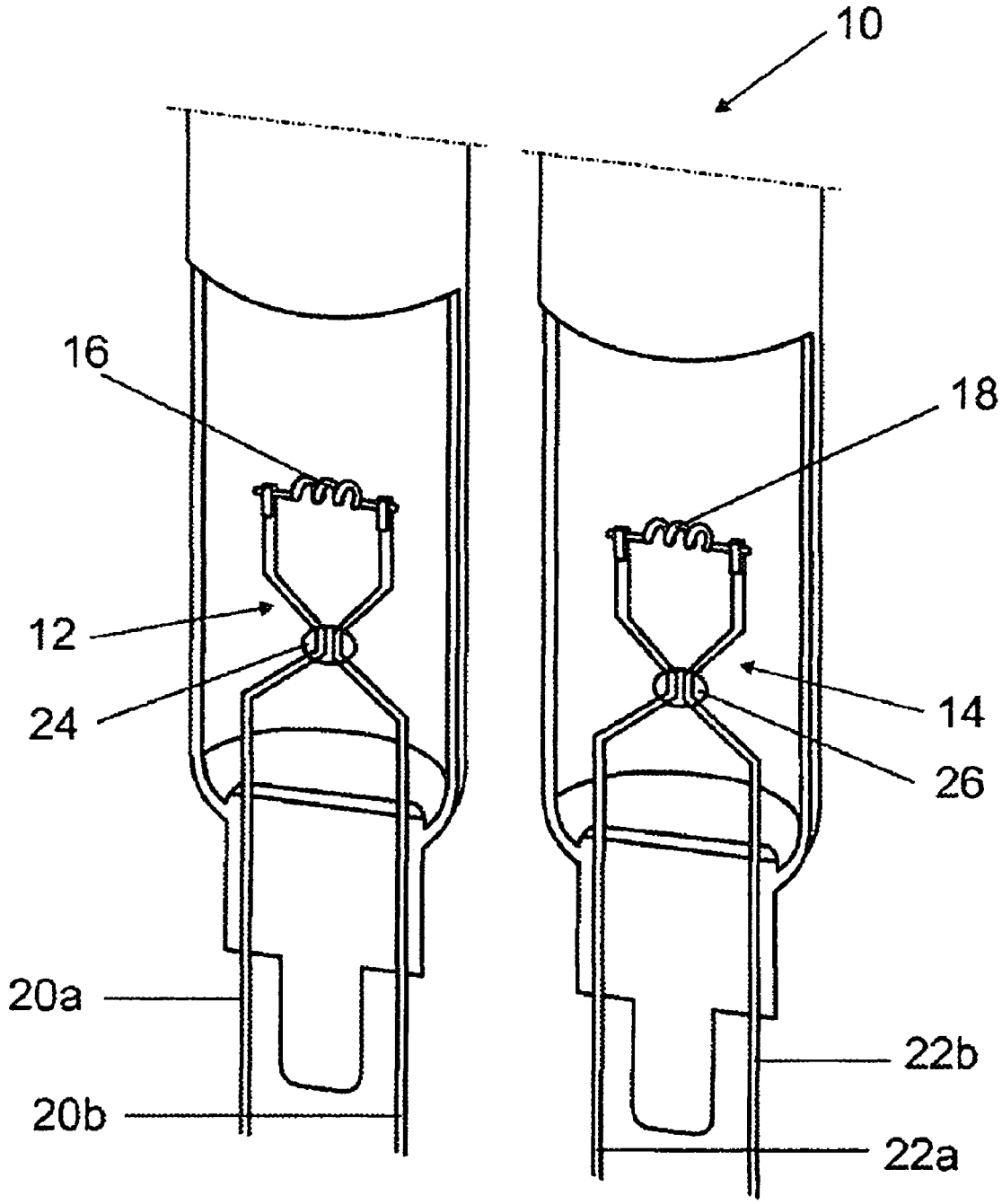
Figure 3:
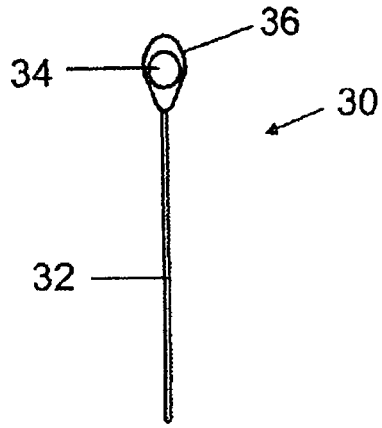
Figure 4:
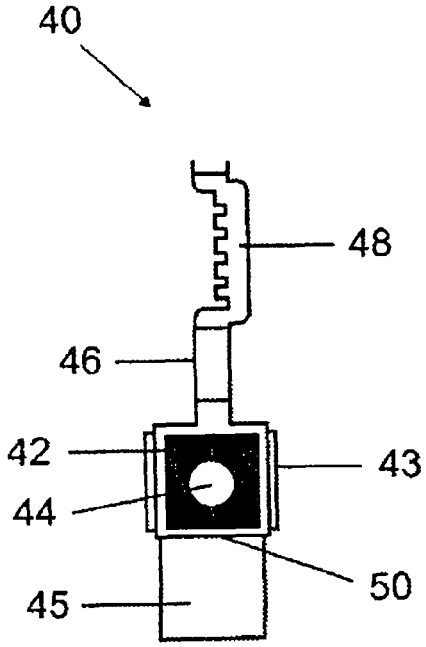
Figure 5:
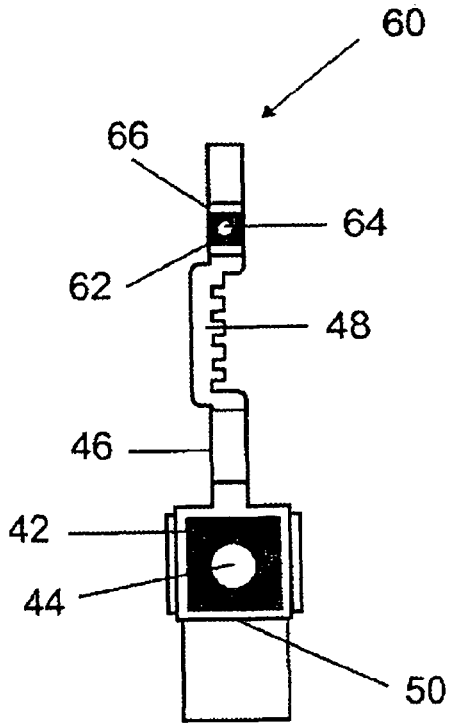
Figure 6:
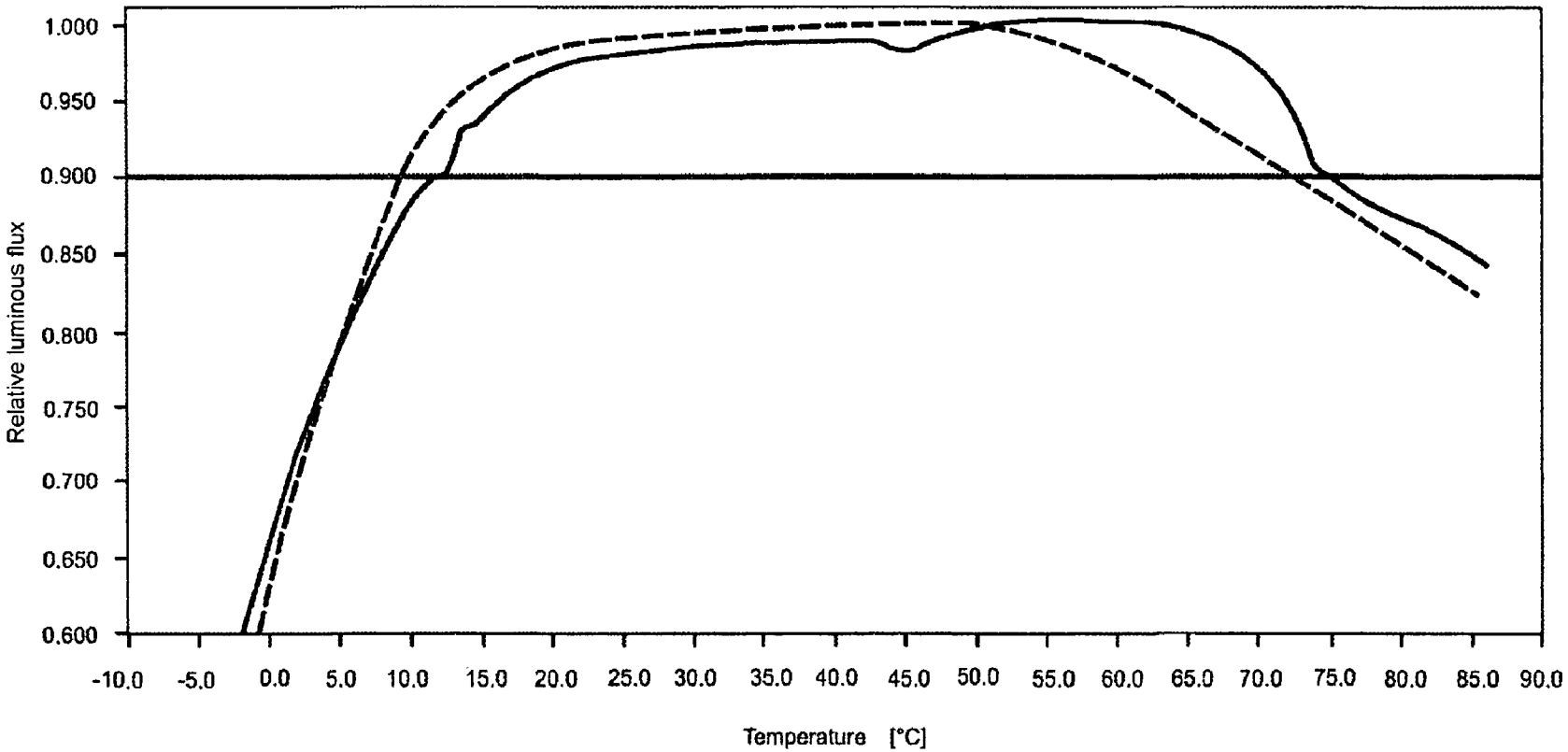

The invention will be explained in more detail below with reference to preferred exemplary embodiments. In the drawings:

FIG. 1 shows a partial view of an amalgam low-pressure discharge lamp in accordance with the prior art, FIG. 2 shows a partial view of a discharge lamp in which a mercury source according to the present invention can be used, FIG. 3 shows a mercury source according to the first exemplary embodiment of the invention, FIG. 4 shows a mercury source according to the second exemplary embodiment of the invention, FIG. 5 shows a mercury source according to the third exemplary embodiment of the invention, and FIG. 6 shows an illustration of the relative luminous flux over the temperature for mercury sources according to the first and second exemplary embodiments.

PREFERRED EMBODIMENT OF THE INVENTION

FIG. 2 shows a discharge vessel 10, in which mercury sources according to the present invention can be used. Electrodes 12, 14, which have a respective filament 16, 18, are provided on the opposite end sections of the discharge vessel 10.

Power supply wires 20*a*, 20*b* to a filament 16 of the electrode 12 and power supply wires 22*a*, 22*b* to a filament 18 of the electrode 14 are introduced into the respective end section of the discharge vessel 10. The power supply wires 20*a*, 20*b* are connected in electrically insulating fashion by means of a glass bead 24, while the power supply wires 22*a*, 22*b* are connected by means of a glass bead 26, with the result that the alignment of the respective filaments 16, 18 is maintained owing to this insulated mechanical connection between the power supply wires.

FIG. 3 shows a mercury source 30 according to the first exemplary embodiment. The mercury source 30 has a wire 32, with a substantially spherical working amalgam 34 being fastened on one end section thereof, which working amalgam is provided with a coating layer 36. The coating layer preferably comprises titanium.

Such a mercury source 30 according to the first exemplary embodiment is produced in which, firstly, a wire 32, preferably made from a material which does not form an amalgam with mercury, such as iron or titanium, for example, is cut to the desired length and heated at the end.

Then, a working amalgam sphere, as is known from the prior art, is provided and one end of the heated wire 32 is inserted into the amalgam sphere. After cooling and solidification, a phase of titanium powder and a rheological additive, the starting material for the coating layer, is preferably provided, and the amalgam sphere located on the wire is preferably provided with the coating layer by means of dip-coating. Then, a drying process takes place.

In order to provide a desired layer thickness of the coating layer, the process of dip-coating and drying can be repeated any desired number of times.

A mercury source 30 produced in this way is fastened on at least one of the electrodes 12, 14. For this purpose, the mercury source 30 is positioned in such a way that the working amalgam 34 is opposite the filament 16, with respect to the glass bead 24, with the result that the free end section of the wire 32 points in the direction of the filament 16. The distance between the working amalgam 34 and the filament 16 can be set in a desired manner, with the result that a desired temperature is present at the working amalgam 34 during operation of the low-pressure discharge lamp.

In such a mercury source, the production process can be simplified, and the distance between the working amalgam and the filament can be set with a high level of flexibility. Owing to the coating layer which comprises titanium, an additional getter effect is provided in the discharge vessel. As a result, for example, hydrogen is bound in the discharge vessel. The coating layer 36 also prevents semi-liquid working amalgam from dripping into the discharge vessel. The requirements in terms of geometry placed on the working amalgam 34 present in spherical form are less stringent than in the prior art, with the result that the production of the working amalgam 34 is also associated with lower costs.

Metal in powder form is preferably used as the material for the coating layer. The determination of the metal for the coating layer also takes into consideration the fact that the getter effect is present in the working temperature range of the amalgam. In this case, titanium has proven to be particularly advantageous.

Low-pressure discharge lamps which have a mercury source 30 according to the first exemplary embodiment of the present invention, in tests relating to the luminous flux/temperature response, do not differ from lamps in which the amalgam has been applied to a metal substrate. The mechanical stability of the mercury source 30 was also sufficient for allowing the amalgam to pass through the manufacturing process without being damaged.

In a development (not illustrated) of the first exemplary embodiment, a startup amalgam, preferably likewise with a coating layer, is applied to that end of the wire 32 which is opposite the working amalgam 34. In this case, the startup amalgam points towards the filament, while the working amalgam 34 is provided at a greater distance from the filament. In this case, too, the wire 32 is fastened on the glass bead 24.

According to a further development (not illustrated) of the present invention, a working amalgam can be provided on a wire and a startup amalgam on a further wire with a respective coating layer. In this case, the startup amalgam and the working amalgam can be provided on the glass bead 24 at any desired distance from the filament within the discharge vessel at a desired rotation angle. This makes it possible for the relative luminous flux of the low-pressure discharge lamp to be set by setting the distance from the startup amalgam and the working amalgam to the filament.

FIG. 4 shows a mercury source 40 according to a second exemplary embodiment of the invention. Said mercury source has a perforated structure 42, in which a working amalgam 44 is located. The perforated structure 42 preferably has a cubic shape, which is delimited by side walls 43, and can be opened at least at an end section during production in order to introduce the working amalgam 44. The perforated structure 42 is preferably a stamped part, which, as is illustrated in FIG. 4, is supplied and is sealed when the sphere has been pressed against it. Expandable metal is preferred as the material for the perforated structure 42.

The perforated structure 42 is connected to a fastening section 48, which is preferably in the form of a comb, via a holding section 46. The holding section 46 and the fastening section 48 can likewise be manufactured from expandable metal. As an alternative to this, however, any desired material can be used for the holding section 46 and fastening section 48 if this material meets the requirements of the low-pressure discharge lamp and if this material allows for the perforated structure 42 to be fastened on the glass bead 24 of the electrode 12 via the fastening section 48. The perforated structure 42 has a coating layer 50, which can be manufactured from the same material as the coating layer of the first exemplary embodiment. A lug 45 is provided opposite the fastening section 48 on the perforated structure.

The size of the working amalgam 44 is preferably smaller than the inner dimension of the perforated structure 42, in order to make it possible for the working amalgam 44 to be introduced loosely into the perforated structure 42 during the production process. During the production process, the coating layer 50 is preferably produced by means of dip-coating, with the working amalgam 44 being introduced into the perforated structure 42 and the perforated structure being closed prior to the dip-coating. As in the first exemplary embodiment as well, the dip-coating and the subsequent drying can be provided once or a multiplicity of times in order that a layer with a desired thickness and a desired material composition can be provided on the perforated structure.

As in the first exemplary embodiment, the provision of the mercury source 40 simplifies the production process of the low-pressure discharge lamp, the material costs are lower and, owing to the coating layer 50, a getter effect is provided in the discharge vessel.

FIG. 5 shows a mercury source 60 according to the third exemplary embodiment of the invention. This mercury source 60 has a perforated structure 42, a working amalgam 44, a holding section 46, a fastening section 48 and a coating layer 50 in the same way as in the case of the mercury source 40 of the second exemplary embodiment. In contrast to the second exemplary embodiment, the fastening section 48 is provided between the holding section 46 and a perforated structure 62 in the third exemplary embodiment, in which perforated structure 62 a startup amalgam 64, preferably in the form of a sphere, is located. The perforated structure 62 for the startup amalgam 64 is preferably formed as expandable metal, as is the perforated structure 42, and has a coating layer 66, likewise preferably comprising titanium.

During the production process, the working amalgam 44 is introduced into the perforated structure 42 and the startup amalgam 64 is introduced into the perforated structure 62, and then the coating layers 50 and 66 are applied to the perforated structures 42, 62. The mercury source 60 is fitted to the electrode 12 by means of fastening of the fastening section 48 on the glass bead 24, with the result that the startup amalgam 64 is provided adjacent to the filament. In this way, an elevated temperature in comparison with the working amalgam 44 can be achieved at the startup amalgam 64, with the result that a rapid increase in the luminous flux during switching-on is made possible.

FIG. 6 illustrates the relative luminous flux over the temperature for a mercury source according to the first exemplary embodiment (solid line) and for a mercury source in the second exemplary embodiment (dashed line). This illustration shows that the luminous flux/temperature response of discharge lamps which have a mercury source according to the present invention is excellent over a relatively wide temperature range. Furthermore, the titanium coating does not disrupt the diffusion of the mercury into the working amalgam and out of the working amalgam. With the present invention it is possible to use a cost-effective mercury source with high-temperature amalgam.

According to a development of the third exemplary embodiment, the startup amalgam 64 is applied to an expandable metal surface and the coating layer is provided on the startup amalgam. In this way, the smaller quantity of startup amalgam required in comparison with the quantity of working amalgam is taken into consideration and a cost-effective variant is selected for the production of the startup amalgam 64.

The invention discloses a mercury source for a low-pressure discharge lamp with an amalgam body, which is located on an end face of a wire or which is enclosed in a perforated structure. It is preferable for the amalgam body or the perforated structure, which has a protective coating with a getter effect, to be coated. With the present invention, it is possible to realize a simple production process with low material costs.

LIST OF REFERENCE SYMBOLS

1 Discharge vessel
2 Electrode
4 Electrode
6*a, b* Startup flag
8 Working amalgam
10 Discharge vessel
12 Electrode
14 Electrode
16 Filament
18 Filament
20*a,b* Power supply wire
22*a,b* Power supply wire
24 Glass bead
26 Glass bead

30 Mercury source
32 Wire
34 Working amalgam
36 Coating layer
40 Mercury source
42 Perforated structure
43 Side wall
44 Working amalgam
45 Lug
46 Holding section
48 Fastening section
50 Coating layer
60 Mercury source
62 Perforated structure
64 Startup amalgam
66 Coating layer

The invention claimed is:

1. A mercury source (30, 40, 60) for a low-pressure discharge lamp with an amalgam body (34, 44), characterized in that the amalgam body is located on an end face of a wire (32) or said amalgam body is enclosed in a perforated structure (42, 62).

2. The mercury source as claimed in claim 1, the amalgam body (34, 44) or the perforated structure (42, 62) having a protective coating (36, 50).

3. The mercury source as claimed in claim 2, the protective coating (36, 50) in the working temperature range of the low-pressure discharge lamp having a getter effect, in particular for hydrogen.

4. The mercury source as claimed in claim 2, the protective coating comprising a metal (36, 50) which does not form an amalgam.

5. The mercury source as claimed in claim 1, the amalgam body (34, 44) being substantially spherical.

6. The mercury source as claimed in claim 1, the amalgam body (34) being skewered onto the wire.

7. The mercury source as claimed in claim 1, wherein the amalgam body is enclosed in the perforated structure and the perforated structure (42, 62) comprises expandable metal.

8. The mercury source as claimed in claim 1, with a startup amalgam body (64), which is enclosed in expandable metal (62) or is applied to expandable metal.

9. The mercury source as claimed in claim 7 or 8, wherein said mercury source is connectable to a glass bead (24, 26), which is provided adjacent to the electrode, via a fastening device (48).

10. The mercury source as claimed in claim 9, the fastening device (48) being in the form of a comb.

11. A low-pressure discharge lamp with a mercury source as claimed in claim 1, a fastening device (48) of the mercury source being fitted adjacent to the electrode.

12. The low-pressure discharge lamp as claimed in claim 11 with a glass bead (24, 26), at which the fastening device (48) of the mercury source is fastened.

13. The low-pressure discharge lamp as claimed in claim 11 or 12, the mercury source being fastened adjacent to the electrode (12, 14) in such a way that a startup amalgam body (64) is located closer to the electrode than a working amalgam body (44).

14. A process for the production of a mercury source for a low-pressure discharge lamp having the steps of a) providing a wire (32) and an amalgam body (34), b) introducing an end section of the wire (32) into the amalgam body, and c) applying a protective coating (36) to the amalgam body.

15. The process as claimed in claim 14, in step c) the protective coating (36) being applied by means of dip-coating.

16. The process as claimed in claim 14 or 15 with a step d), which is performed after step c) and in which the protective coating is dried.

17. The process as claimed in claim 14, the protective coating comprising titanium.

18. A process for the production of a mercury source for a low-pressure discharge lamp with the steps of a) forming a perforated structure (42) and an amalgam body (44), b) inserting the amalgam body into the open perforated structure, c) closing the perforated structure (42), and d) applying a protective coating (50) to the perforated structure.

19. The process as claimed in claim 18, the perforated structure (42) comprising expandable metal.

20. The mercury source as claimed in claim 4 wherein the metal is titanium.

* * * * *